US005406310A

United States Patent [19]

Aschenbrenner et al.

[11] Patent Number: 5,406,310

[45] Date of Patent: Apr. 11, 1995

[54] MANAGING COLOR SELECTION IN COMPUTER DISPLAY WINDOWS FOR MULTIPLE APPLICATIONS

[75] Inventors: Jean M. Aschenbrenner, Boulder; Gerald E. Dewlen; Neal R. Pierman, both of Longmont, all of Colo.

[73] Assignee: International Business Machines Corp., Armonk, N.Y.

[21] Appl. No.: 190,728

[22] Filed: Feb. 2, 1994

Related U.S. Application Data

[63] Continuation of Ser. No. 874,870, Apr. 28, 1992, abandoned.

[51] Int. Cl.[6] ..... G09G 5/06; G09G 5/14

[52] U.S. Cl. ..... 345/150; 345/199; 395/131

[58] Field of Search ..... 340/703; 395/131, 153, 395/157, 158; 345/150, 199

[56] References Cited

U.S. PATENT DOCUMENTS 4,550,315 10/1985 Bass et al. .
5,025,249 6/1991 Seiler et al. ..... 340/723
5,091,720 2/1992 Wood .
5,142,615 8/1992 Levesque et al. ..... 395/131

FOREIGN PATENT DOCUMENTS 0392551 10/1990 European Pat. Off. .

*Primary Examiner*—Jeffery Brier
*Attorney, Agent, or Firm*—Homer L. Knearl

[57] ABSTRACT

In a windows environment, a plurality of computer program applications use a common look-up table to allocate colors. When the common look-up table is full, a mechanism must be provided to determine which colors will be stored in the common look-up table. Several alternatives exist; the order of the alternatives can be specified by the user or application program. A first alternative will attempt to allocate colors in the common look-up table with the true image colors called for by the program. A second alternative uses a reduced set (reduced number) of image colors so that they will fit in the common look-up table. The image colors are regenerated from the reduced set through a dithering or error diffusion algorithm. A third alternative is to find the color in the common look-up table which is mathematically closest to the image color. If these alternatives are not used, a new look-up table can be created. When a new look-up table is created, each non-image color is assigned a class, each class having a priority with respect to other classes. When there is a request to allocate an image color to the look-up table which is full, a non-image color is replaced based on its priority. Lowest priority non-image colors are replaced first.

23 Claims, 5 Drawing Sheets

MANAGING COLOR SELECTION IN COMPUTER DISPLAY WINDOWS FOR MULTIPLE APPLICATIONS

This application is a continuation of U.S. Pat. No. 07/874,870, filed on Apr. 28, 1992, now abandoned.

BACKGROUND OF THE INVENTION

1. Field of the Invention

This invention is directed to a method for managing color selection for windowing displays which display multiple computer program applications. More particularly, the inventive method manages color selection among a plurality of program applications, and/or a plurality of images in a single program application, displayed in a multiple windows environment on a single display screen.

2. Description of Prior Art

Window programs, or operating systems, which display multiple program applications on a single computer screen are well-known. Examples include the X-Windows program that runs in the UNIX environment, the Microsoft Windows program that runs in the DOS environment, and IBM's OS/2 operating system. Particularly, with regard to X-Windows, the operator may select a plurality of color tables for controlling the colors to be displayed when a given application program is active on the display screen. Active, as used herein, means the operator is currently working with that application. This would typically be indicated by the presence of the display cursor in the window of the active application. There are many more colors available to a display than are practical for storage in a color table. For example, if 8-bit bytes are used to express the intensity for each of the primary colors, red, green and blue, there are a total of $2^{24}$ possible colors that may be displayed. To store this many color choices is impractical; typically, the color table for a display screen contains 256 locations. For any given display, the system loads up to 256 of the possible $2^{24}$ color choices in the color table for the display. The window manager then uses colors from this active table to display all objects on the screen while the application associated with those color choices is active.

If during the switching from a first to a second application the active set of 256 colors is changed, the screen colors will change. This produces an annoying screen flashing effect to the user, as the user sees the display screen change colors when moving the cursor from one application window to the next application window. This screen flashing is sometimes referred to as the technicolor effect. This problem is most likely to occur when an application uses one or more video images. Such images contain multiple color choices that can soon use up the 256 choices available to the display.

The use of multiple color tables, or color maps, for different applications, or different images, in a single application is well known. It is also well-known to set pixel priorities by window so as to be able to overlay windows on the screen. Techniques for overlaying windows and displaying the correct color for each pixel are taught in U.S. Pat. Nos. 4,550,315; 5,091,720; and published European Patent Application 392,551. None of these patents or publication acknowledges the problem of the technicolor effect, or suggests any solution for the problem.

SUMMARY OF THE INVENTION

It is an object of this invention to eliminate, or minimize, the screen flashing, or technicolor effect, in windowing displays.

In accordance with this invention, the above problem has been solved by first allocating color table locations in a common color table to a set of base colors, second allocating color table locations to true image colors for an image in an application, and/or then reallocating table locations between image colors and base colors if the table is filled before all the image colors are loaded. Base colors are the non-image colors assigned to (1) graphics, (2) window backgrounds, borders and icons, and (3) highlighting; these colors are hereinafter referred to as the vector, the interface and the highlight colors, respectively. Base colors may also include other application colors.

There are a number of ways to reallocate locations, or slots, in the common color table to different colors. One method of allocating for image colors is to use reduced color sets for the image color set and then regenerate the image colors from the reduced set with well-known diffusing algorithms. Another method for allocating image colors is to substitute the closest previously-loaded colors in the table for an unloaded image color.

If the above reallocation of image colors and base colors is not acceptable to the user, then the technicolor effect, or color flashing, cannot be prevented during application switching, or image switching, within an application; however, the technicolor effect can still be minimized. The minimization is accomplished by assigning priority to the base colors, and reallocating base color slots in the new color table to image colors based on the assigned priorities of the base colors.

The priorities are assigned by class, or category, of use. The lowest priority is assigned to the interface (or background and border) colors; the next higher priority is assigned to highlight colors; and the highest priority is assigned to the vector (or graphical) colors. Vector and highlight colors are given a higher priority over interface colors since the vector, or highlight, colors are usually imposed, or overlaid, in the image field of the screen. The interface colors, on the other hand, are simply there for decorative purposes and do not directly impact the users interaction with the system.

All colors within a class have the same priority in the preferred embodiment. Alternatively, colors within a class could be assigned priorities within the class.

The method of reallocation based on priorities comprises finding a base color with the lowest priority and replacing the base color in that table slot with an unloaded image color. These steps repeat until all of the image colors are loaded. Since some base colors have been replaced, there will be some flashing as the operator moves from a first application to the second application, or from image to image in the same application. However, the flashing is minimized in that base colors are replaced only as necessary, and the least significant base colors are replaced first.

Other objects, advantages and features of the invention will be understood by those of ordinary skill in the art after referring to the complete written description of the preferred embodiments in conjunction with the following drawings.

DESCRIPTION OF THE PREFERRED EMBODIMENTS

The invention may be run on a variety of computers under a number of different operating systems. The computer could be, for example, a personal computer, a mini computer, a RISC computer, or a main frame computer. The computer may be a standalone system, part of a network, such as a local area network or wide area network, or a larger teleprocessing system. For purposes of illustration only, the invention is described below as implemented on IBM's RISC System/6000 computer. Further, the operating system on which a preferred embodiment of the invention is implemented is AIX, but it will be understood that the invention could be implemented on other and different operating systems.

Figure 1A:
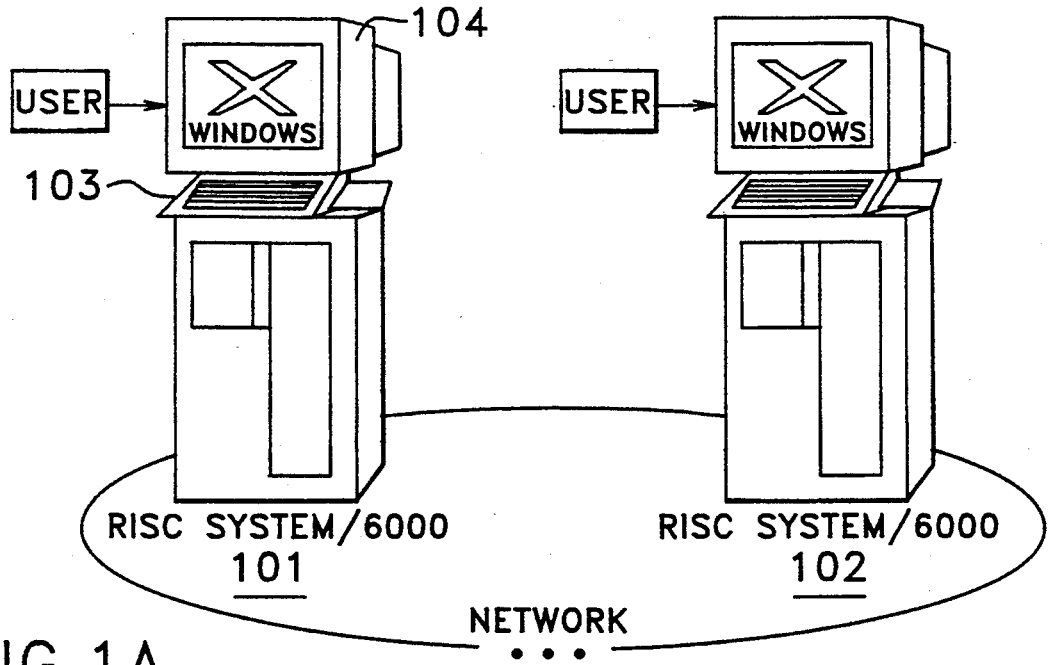
FIG. 1A shows computing systems in which the preferred embodiment of the invention is implemented.

FIG. 1A shows workstations 101 and 102 using RISC System/6000 computers connected in a network. The workstations comprise well known components, such as a central processing unit, ROM, RAM, one or more system busses, a keyboard 103, a mouse and a display 104. Further information can be found on the RISC System/6000 computer in IBM RISC System/6000 POWERstation and POWERserver Hardware Technical Reference—General Information Manual (SA23-2643), IBM RISC System/6000 POWERstation and POWERserver Hardware Technical Reference—Options and Devices (SA23-2646), IBM RISC System/6000 Hardware Technical Reference—7012 POWERstation and POWERserver (SA23-2645). In the preferred embodiment of the invention, X-Windows is running on the workstation.

Figure 1B:
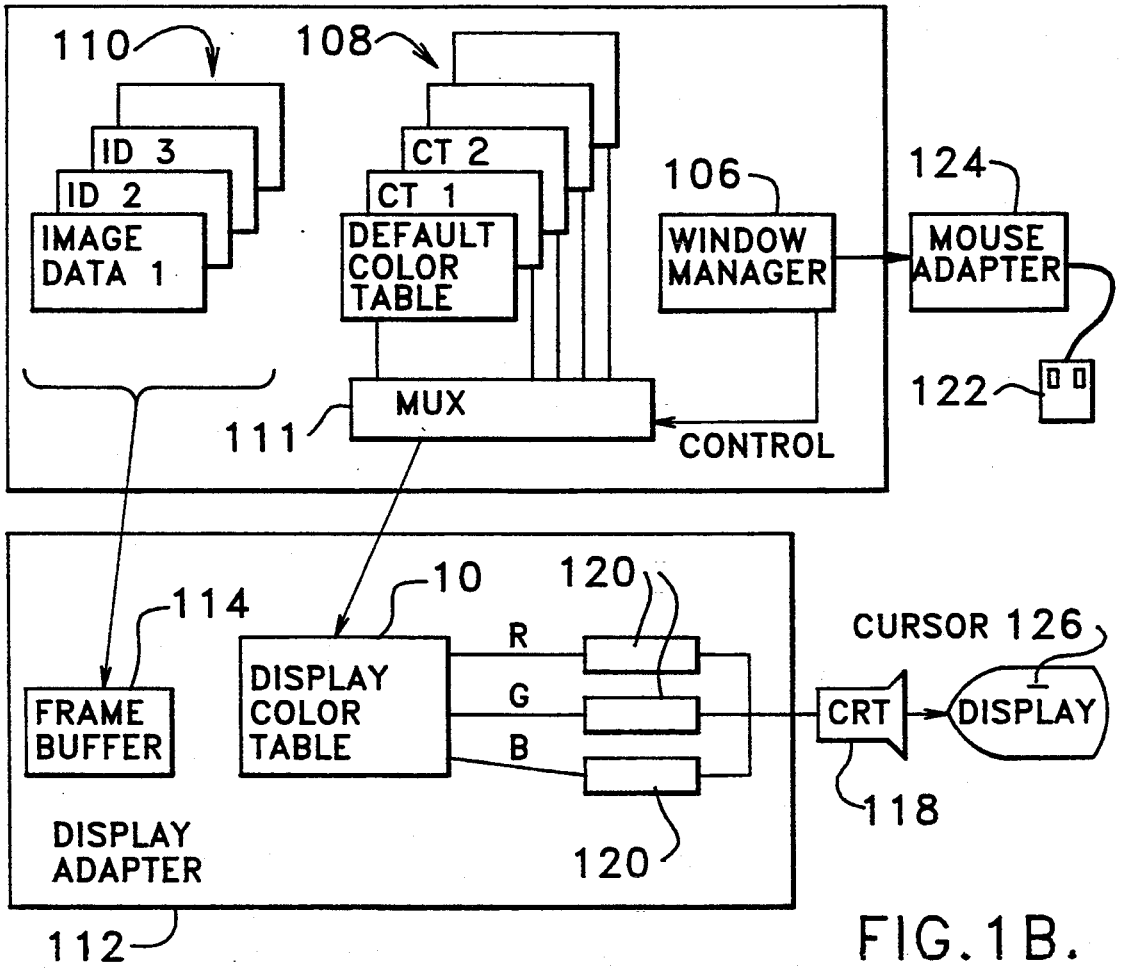
FIG. 1B shows the invention as implemented in a RISC System/6000 workstation in FIG. 1A.

In FIG. 1B, central processing unit 105 includes RAM in which the window manager program 106, color tables 108 and image data frames 110 are stored. The window manager program 106 in the X-Windows program is used by the central processing unit to build the color tables 108 for application image data 110. Once one or more color tables are built, the window manager will select the one color table to be transfered through the multiplexer to the display color table 10 in display adapter 112.

CPU 105 under control of the window manager program also builds display data for a frame buffer 114 in the adapter 112. The frame buffer contains the digital representation of the frame to be displayed on screen 116 by CRT 118. Each pixel (display point) in the frame buffer carries an index to a color in the display color table 10. When a pixel is to be displayed, its color in red, green, blue intensities is passed to red, green, blue drivers 120 that drive the three color guns in CRT 118.

The user communicates with the CPU and thus the window manager program with a screen pointer, i.e., mouse 122. The mouse is connected to the CPU and the window manager through a mouse adapter 124. Mouse 122 is used to control a cursor 126 on the screen 116. The graphic user interface supported by X-Windows window manager allows the user to "point and shoot" by moving the pointer, or cursor, 126 to a window, or icon in a window representing an object at a specific location on the screen 116, and by pressing one of the mouse buttons to perform a user command or selection. Those skilled in the art understand that pointing devices, such as a touch sensor, graphic tablet, trackball, or joystick, could alternatively be used to manipulate the pointer across the graphical user interface.

Figure 1C:
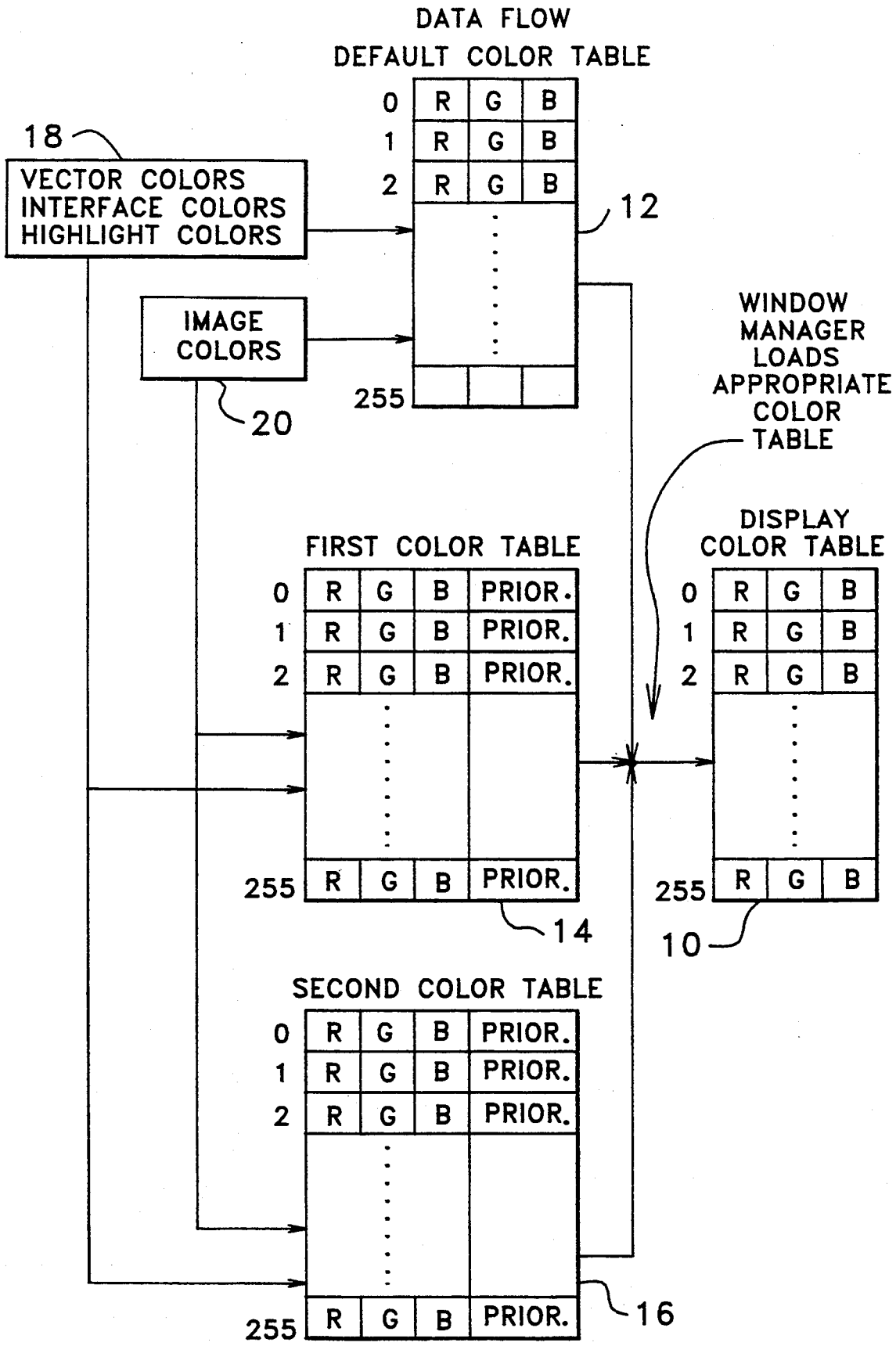
FIG. 1C shows the color data flow in the preferred embodiment of the invention.

FIG. 1C illustrates the data flow that occurs in the preferred embodiment of the invention. The CRT 118 has three color guns (red, green and blue) to generate the colors on the screen. Each storage location 0–255 in the table 10 contains 24-bits, an eight-bit byte for each of the primary colors, red, green and blue. Accordingly, each primary color has $2^8$ or 256 variations in shade from no intensity at 0, to brightest red, green or blue at 255. Since there are $2^8$ intensities for each primary color and there are three primary colors, the possible color choices are $2^{24}$. Only 256 of these possible choices are loaded in the display color table by the window manager program.

The window manager may load the display color table 10 by transferring the contents from one of a plurality of color tables. FIG. 1 shows three color tables whose contents may be transferred to the display color table. Any number of color tables could be used depending on the complexity of choices made by the user of the system. In the preferred embodiment of the invention, the objective of eliminating color flashing, or the technicolor effect, is accomplished when the default color table 12 is used. If the user chooses to generate other color tables (i.e., as first color table 14, second color table 16, etc.), there will be some technicolor effect; however, the invention will still minimize that effect.

The color choices that will be loaded into tables 12, 14 or 16 are the base colors 18 and the image colors 20. The base colors are always loaded first into a color table; thereafter, the program attempts to load the image colors as prompted by the user. During the loading of each color, the window management program checks to see if the same identical color is already loaded. If that color is already loaded, it will not be loaded again in a second location of the table. The method by which colors are selected for loading in one of the tables 12, 14 or 16 is shown in the flowcharts in FIGS. 2–6.

Figure 2:
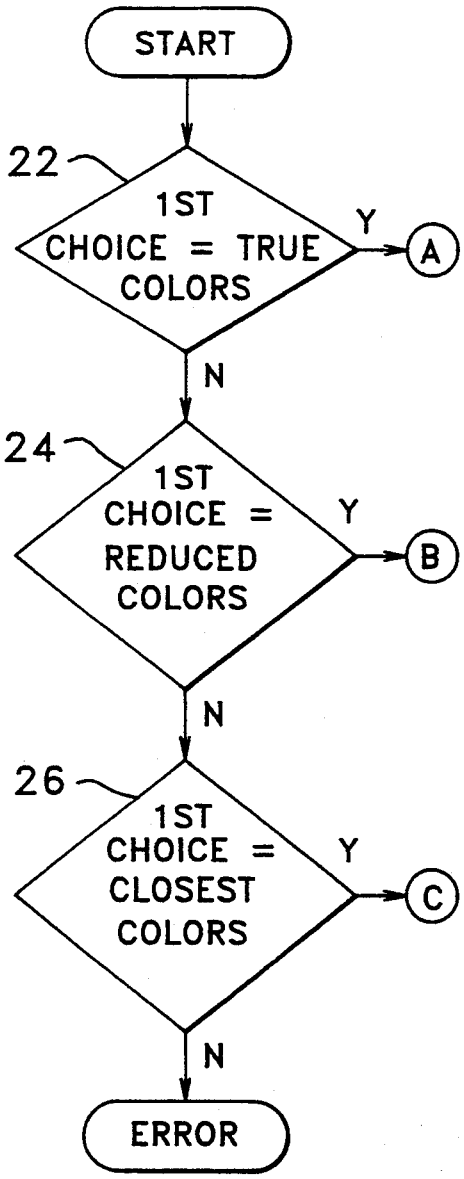
FIG. 2 is a flowchart of the first level of decisions in the invention.

In FIG. 2, the window manager presents the application program, or user, desiring to load image colors into the default table with three choices. An application program could specify choices by command, or the choices could be presented to a user by means of a screen display menu. In the latter case, a user would generate a command or choice by a key stroke on a keyboard or mouse control. The choices for the image colors are true color set, reduced color set and closest color set. Decision blocks 22, 24 and 26 test for choice made by the application, or user, and cause the window manager program to branch to the routine to implement the choice.

Figure 3:
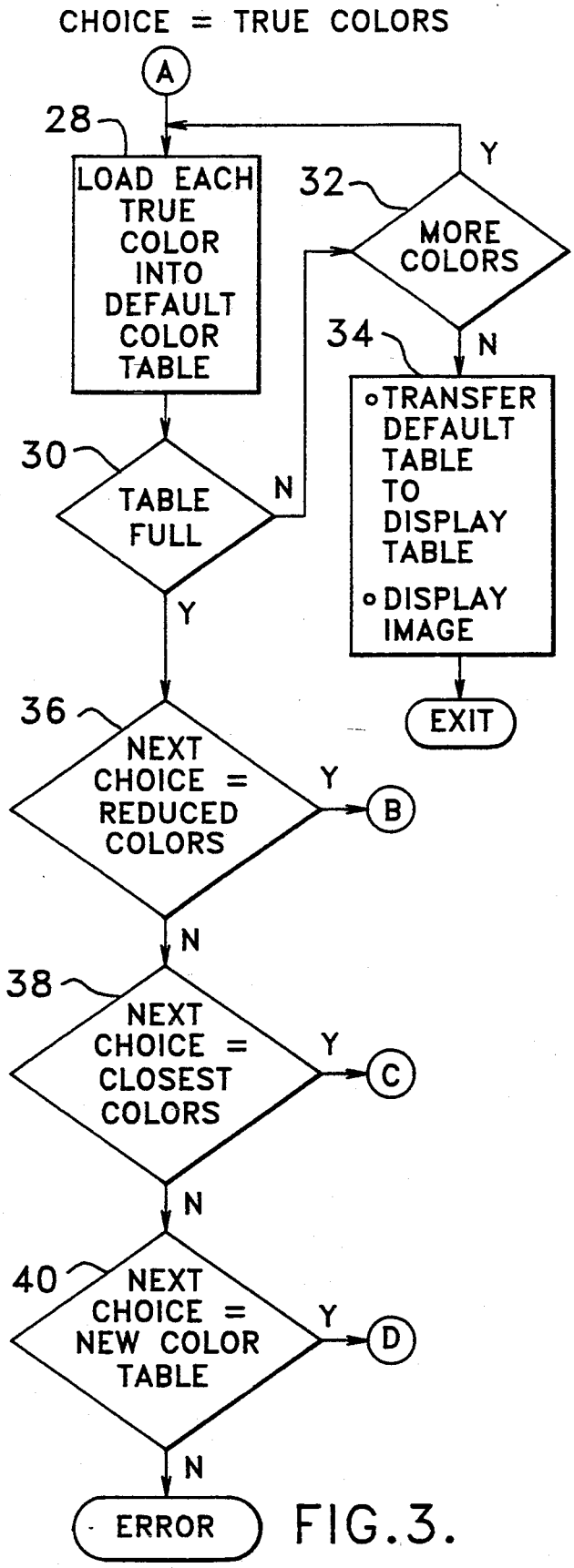
FIG. 3 is a flowchart illustrating the process for adding a true color set into the default color table.

If the choice is true color set, the process branches to FIG. 3. Step 28 in FIG. 3 loads each of the colors in the true color set for the image into the default color table. As each color is loaded into a slot, or storage location, decision block 30 tests to see if the default table is full. If more image colors are to be loaded, decision 32 returns the process back to step 28, and the next color is loaded. If all image colors have been loaded, decision 32 branches the process to step 34. At step 34, the window manager transfers the contents of the default table 12 to the display table 10. The window screen is displayed with the active application displaying the image in its true colors.

Of course, the use of the true color set may fail because the default table fills before the true color set is completely loaded. As discussed above, the base colors are the first colors loaded into the default table. Typically, the number of vector colors loaded will range from 16 to 64, the number of highlight colors loaded will be less than 8, the number of interface colors loaded will be 16 to 32. Therefore, before the image for the current application is loaded, the default table may already have more than 100 colors already loaded in it. Further-more, other application programs may have loaded colors in the default table. Thus, the default may have over 200 slots available, or may have less than 50, depending on the situation.

If during the loading of the true color set decision 30 detects that the default table 12 is full, the process branches to query the application, or user, for the next choice. Choice preferences could be preloaded or, in each instance of a choice, a menu could appear for the user or operator to select a choice. After the true color set fails, the choices are reduced color set, closest color or create a new color table; i.e., tables 14 or 16 in FIG. 1, other than the default table 12. Decisions 36, 38 and 40 test for reduced set choice, closest color choice and new table choice, respectively.

Figure 4:
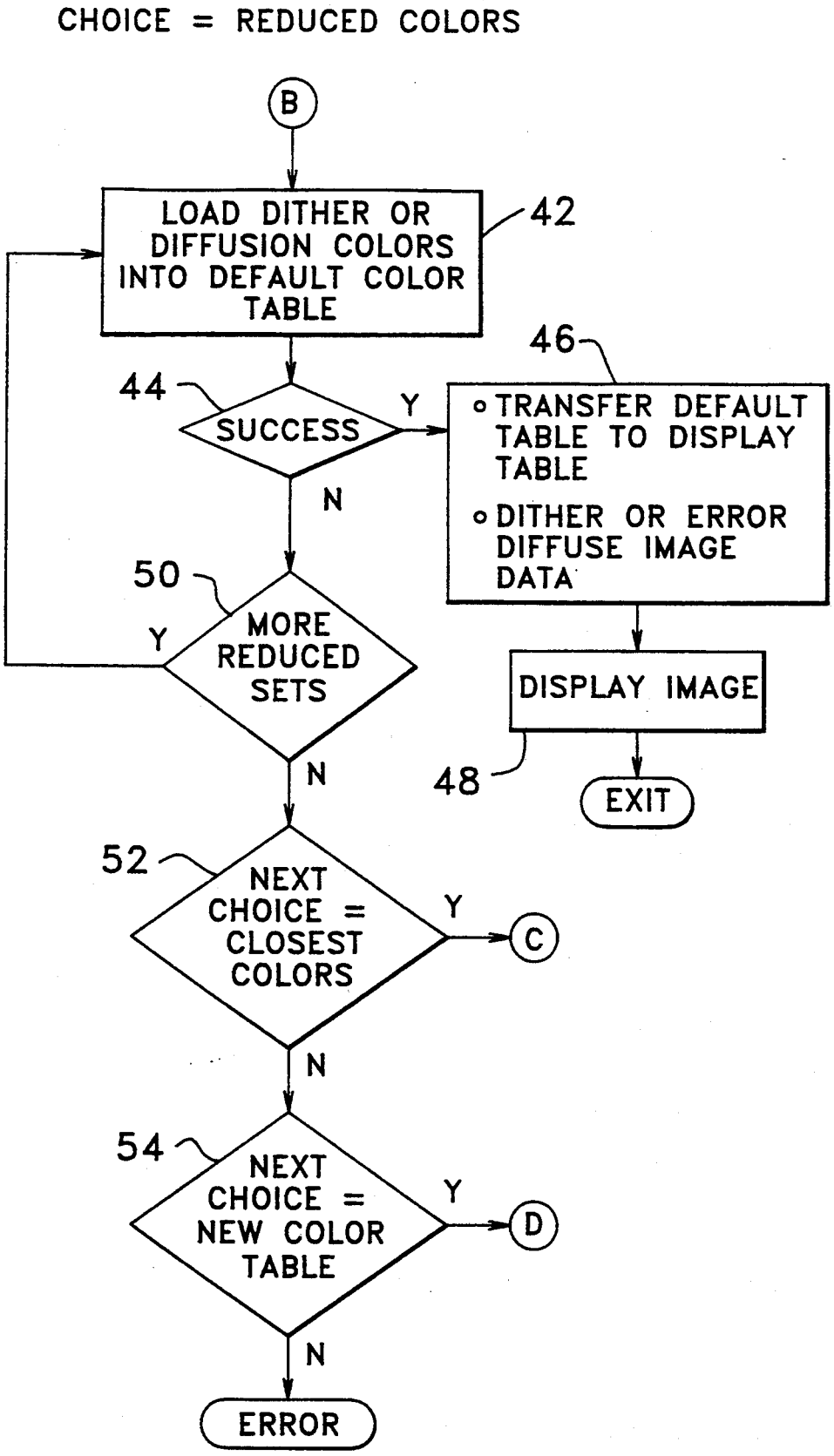
FIG. 4 is a flowchart illustrating the process for adding a reduced color set into the default color table.

If the choice is reduced color set, decision 36 branches the process to FIG. 4. Step 42 in FIG. 4 attempts to load a predefined reduced set of colors into the default table. Decision 44 tests to see if the reduced set was successfully loaded. (Decision 44 could be implemented in the same manner as decisions blocks 30 and 32 in FIG. 3.)

If the reduced set was successfully loaded, decision 44 branches the process to step 46. In step 46, the window manager program transfers the contents of the default table to the display table. Step 46 then uses a dither, or error diffuse algorithm, to reconstruct the image colors from the reduced color set. Dither algorithms for regenerating colors from a reduced set are well-known. One such technique is described in "Color Image Quantization For Frame Buffer Display" by Paul Heckbert, *Computer Graphics*, July 1982, Volume 16, Number 13, pages 297–307

. After the colors are regenerated, step 48 then displays the windowing screen with the active application window containing the desired image.

If the reduced color set is not successfully loaded into the default table, the response to decision 44 is no, and the process moves to decision 50. Decision 50 checks for another reduced set of colors. In the preferred embodiment, there are three reduced sets of colors. One set has 225 colors—all possible combinations of 5 reds, 9 greens, and 5 blues; a second set has 147 colors—all possible combinations of 7 reds, 7 greens and 3 blues; the last set has 45 colors—all possible combinations of 3 reds, 5 greens and 3 blues. In each case, the selected primary colors are equally distributed in intensity. For example, five greens would be a green at each end of the intensity range, plus three additional shades of green equally distributed across the range.

The reduced color sets could be tried in step 42 in a predefined sequence—first the 225 color set, second the 147 color set, and last the 45 color set. Alternatively, a menu could be provided on the screen to query the user for the reduced color set choice. If none of the reduced sets will fit in the default table, or if the user does not wish to try more reduced color sets, decision 50 branches to decision block 52.

In FIG. 4, decisions 52 and 54 test the user, or application program, to determine if the process should try closest colors or create a new color table in addition to the default table. If the user elects to use closest colors for the image in the application, decision 52 branches the process to FIG. 5.

Figure 5:
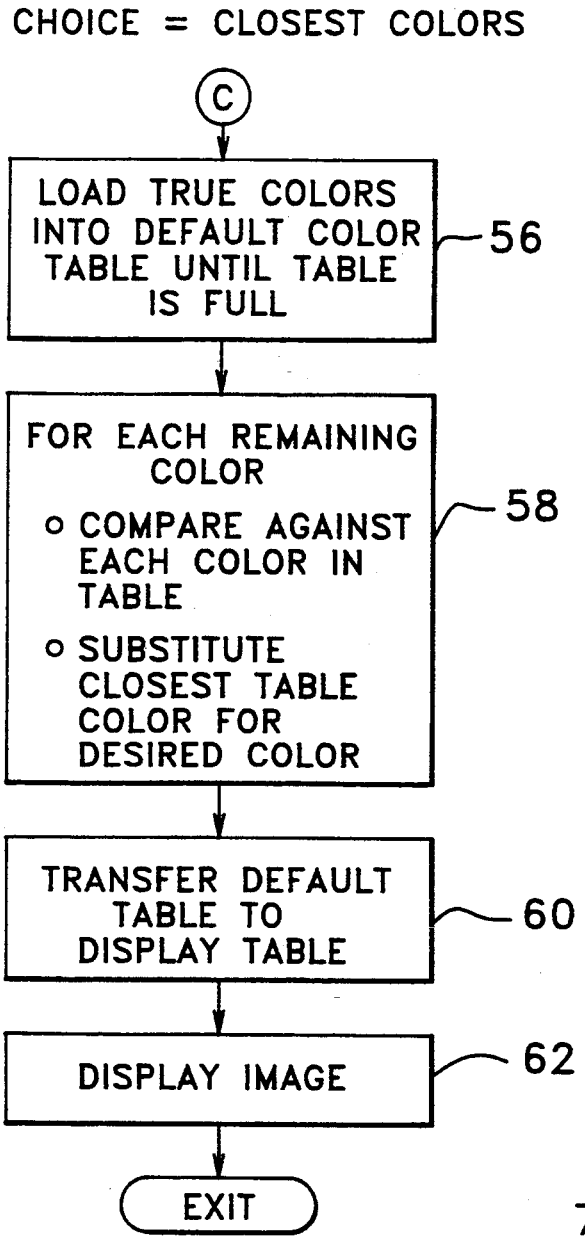
FIG. 5 is a flowchart illustrating the process for adding a closest color set into the default color table.

Step 56 in FIG. 5 loads the true colors for the image in available slots in the default table after the base colors have been loaded. When the default table becomes full, step 58 in the process takes over. In step 58, each remaining (unloaded) image color is compared against the colors already in the table. The closest color to the desired image color is then substituted for the unloaded image color. This comparison and substitution is repeated until all unloaded image colors have been replaced by a selected color already loaded.

The comparison step in block 58 in the preferred embodiment is accomplished by treating the red, green and blue values for each color as coordinates for a point in three dimensional space. The distance between two colors is then the distance between two points in three-dimensional space. The closest color relative to an image color is the already-loaded color that is the shortest distance from the image color in three dimensional space.

The substitution step in block 58 in the preferred embodiment is done by changing the color address, or color index, for a pixel in the image. In other words, if a pixel had a color address of 20 and that color was substituted for a color at color address 90, then every pixel with color address 20 would be given color address 90 instead.

After substitution of a previously-loaded color for each of the unloaded image colors, step 60 in the window manager transfers the default table to the display table. In step 62, the window manager displays the windows on the screen, including the image in the active application window. The color management process in the window manager then exits.

The closest color process does not fail in the sense of never being able to find a color for the image colors. In other words, the default table is never overfilled. The only question in using the closest color process is whether the color substitutions will be acceptable to the user.

If the user, or the application program, is unsuccessful in using the true color process, the reduced color process or chooses not to use the closest color process, then the only choice is to create a color table in addition to the default table. The result of such a choice is that there will be flashing when the user switches to applications, or images, that do not use the default table. However, the process in FIG. 6 for creating the new color table will minimize the flashing or the technicolor effect.

Figure 6:
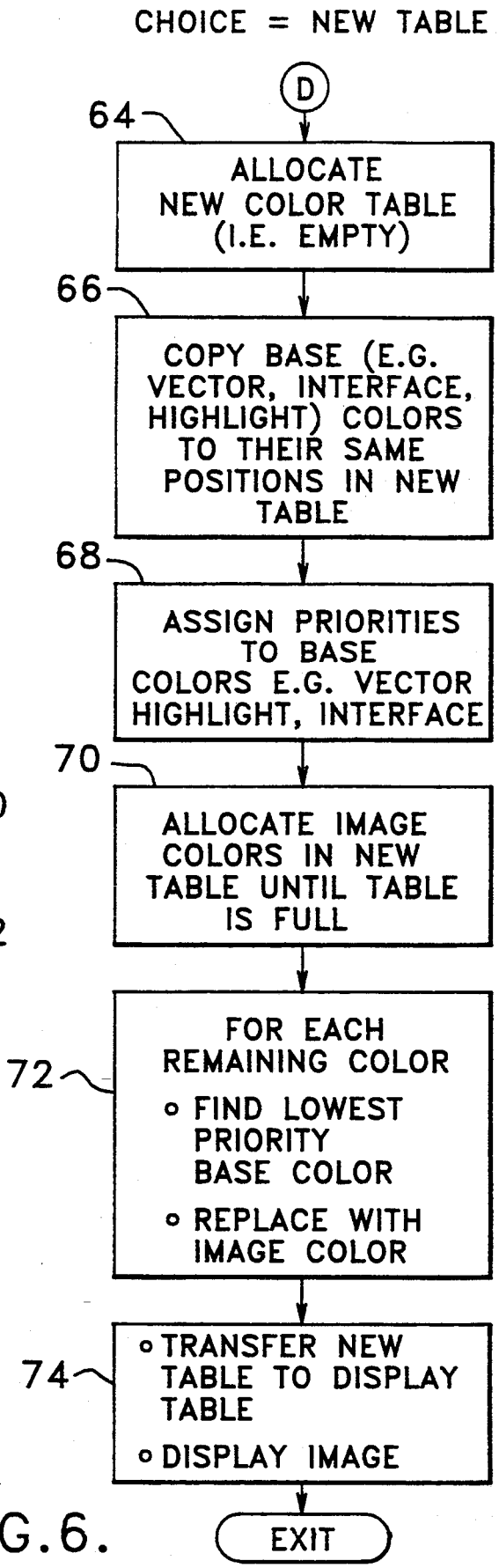
FIG. 6 is a flowchart illustrating the process for creating a new color table as an alternative to the default color table.

In FIG. 6, step 64 allocates storage space (256 locations) for a new color table, first color table 14 (FIG. 1), for example. Step 66 loads the base colors—vector colors, highlight colors, and interface colors. As each color is loaded, step 68 assigns a priority and loads it with the color. The priority is assigned by class; all vector colors are assigned the highest priority; all highlight colors are assigned the next lower priority; and all interface colors are assigned the lowest priority.

In step 70, the process allocates remaining slots in the color table to the image colors until the new table is full. For each remaining (unloaded) image, color step 72 in the process first finds the first, lowest-priority base (non-image) color in the table. Since interface colors have the lowest priority, the process will take the first interface color it comes to. The interface color in that slot, or location, is then replaced by the image color. The process repeats until all image colors are loaded. In effect, the interface colors, then the highlight colors, and finally vector colors will be replaced until all of the true colors for the image are loaded in the new table.

In step 74, when the window manager transfers the new table into the display color table, some base colors on the screen will flash because they have been changed from default colors. However, the flashing is minimized to the extent that base colors are replaced only as necessary and the most significant base colors are replaced last. The most significant base colors would be the vector and highlight colors which are likely to appear with or overlay the image. After step 74, the color management process exits.

While a number of preferred embodiments of the invention have been shown or described, it will be appreciated by one skilled in the art, that a number of further variations or modifications may be made without departing from the spirit and scope of our invention.

What is claimed is:

1. In a windows environment in a computer system having a processor, a memory and a display in which a set of colors for each program application presented on the display is managed in a single common look-up table in said memory, wherein all locations in said look-up table are fully accessible to all applications in said windows environment, a method for selecting said set of colors, comprising the steps of:

first allocating locations in said common look-up table to a first set of colors, assigning a priority to each color in said first set;

second allocating locations in said common look-up table to a second set of colors;

said second allocating step allocating locations in said common look-up table to each color in said second set unless a color in said second set was allocated a location in said common look-up table by said first allocating step;

testing for whether said look-up table is full before all colors in said second set are allocated locations; and in response to said look-up table being full before all colors in said second set are allocated locations, replacing individual colors of said first set with individual colors of said second set in said common look-up table, lowest-priority colors of said first set being replaced first.

2. The method of claim 1 wherein said second allocating step comprises:

loading in said common look-up table a set of true colors for said second set of colors.

3. The method of claim 1 wherein said second allocating step comprises:

loading in said common look-up table a reduced set of colors from which said second set of colors can be regenerated using a dithering or diffusion algorithm.

4. The method of claim 1 wherein said second allocating step comprises:

substituting a mathematically closest color already in said table for each color in said second set that is not in said common look-up table in order to obviate said replacing step.

5. In a window environment having multiple program applications with separate color sets displayed concurrently, said environment operating in a computing system having a display color table, a default color table and a window manager program for transferring colors to be displayed from said default table to said display table, said display table being a table with all locations therein fully accessible to all program applications in said window environment, a method in said window manager program for managing color selection, comprising the steps of:

allocating base colors to locations in said default table;

allocating image colors for each of said program applications to locations in said default table; and if said image colors allocating step fills said default table before all of said image colors are allocated a location, reallocating a previously-allocated color location to each unallocated image color until all image colors are allocated a location in said default table.

6. The method of claim 5 wherein said reallocating step comprises:

replacing colors in allocated image color locations with a reduced color set for said image colors, said reduced set having fewer colors than all image colors.

7. The method of claim 5 wherein said reallocating step comprises the steps of:

loading a first reduced color set for said image colors in image color locations in said default table, said first reduced color set having fewer colors than all image colors;

testing for said default table being full before said first reduced color set is completely loaded therein; and in response to said default table being full, replacing colors in image color locations allocated to said first reduced color set with a second reduced color set having fewer colors than said first reduced color set.

8. The method of claim 5 wherein said reallocating step comprises the steps of:

loading a true set of colors for said image colors;

testing for said default table being full before said true set is completely loaded; and substituting a color already loaded in said default table for each not loaded color in said true set that was not loaded before said table was full, said substituted color being an already loaded color in said table that is closest in color and intensity to said not loaded true color.

9. The method of claim 8 wherein each color location is defined by a color address and said substituting step comprises the steps of:

comparing a not loaded true color to each already loaded color to determine said closest already loaded color;

changing the color address of said not loaded true color to the color address of said closest already loaded color; and repeating said comparing and address changing steps until all true colors have a color address in said default table.

10. The method of claim 5 wherein said computing system has a first color table in addition to said default table and said window manager program transfers colors to be displayed to said display table from said first table rather than from said default table, and said method in addition comprises the steps of:

allocating said base colors to locations in said first color table;

assigning each of said base colors to one or more classes, each class having a priority with respect to every other class;

allocating said image colors to locations in said first table until said first table is full; and when said first table is full, allocating image colors to base color locations in said first table to replace allocated base colors with unallocated image colors until all image colors are loaded, lowest priority base colors being replaced first.

11. The method of claim 10 wherein said table full allocating step comprises the steps of:

finding a location in said first table containing a lowest priority base color;

replacing said lowest priority base color with an unallocated image color; and repeating said finding and replacing steps until all image colors are allocated a location in said first table.

12. In a windows environment in a computer system having a processor, a memory and a display, a common set of colors in said memory to be presented in one or more windows on said display, said common set of colors being managed in a single color table that is fully accessible to all applications in said window environment, apparatus for selecting said common set of colors, comprising:

first means for allocating memory locations in said color table to a set of non-image colors;

means for assigning a priority to each color in said non-image set;

second means for allocating memory locations in said color table to a set of image colors, at least some colors being common to both said image and non-image sets;

said processor testing whether all memory locations for said color table are filled before all of said set of image colors has been allocated memory locations in said color table; and means, in response to said color table memory locations being full before all of said set of image colors has been allocated memory locations, for replacing individual non-image colors in said color table with an unallocated image color until all of said set of image colors has been allocated memory locations, lowest priority non-image colors being replaced first.

13. The apparatus of claim 12 wherein said second allocating means comprises:

means for loading in said color table memory locations a set of true colors for said set of image colors.

14. The apparatus of claim 12 wherein said second allocating means comprises:

means for loading in said color table memory locations a reduced set of colors from which image colors can be regenerated using a dithering or diffusion algorithm.

15. The apparatus of claim 12 and in addition:

means, in response to all memory locations of said color table being filled before all of said set of image colors has been allocated memory locations and before said replacing means replaces non-image colors, for substituting a mathematically closest color already in said color table for each image color in said set of image colors that is not in said color table.

16. In a window environment in a computing system having a processor, a memory, a display, a single display color table containing a color set that is fully accessible to all program applications in said window environment, a default color table in said memory, and a window manager program for transferring colors to be displayed from said default table to said display table, a program module in said window manager program for managing selection of said color set, comprising:

means for allocating base colors to locations in said default table;

means for allocating image colors for each of said program applications, when an image color is different from said allocated base colors, to locations in said default table until said default table is full; and means for reallocating a previously allocated base color location to an unallocated image color until all unallocated image colors are allocated a location in said default table whereby said default table includes all image colors and a reduced set of said base colors.

17. The program module of claim 16 wherein said reallocating means comprises:

means for replacing colors in allocated image color locations with a reduced color set for said image colors, said reduced set having fewer colors than all image colors.

18. The program module of claim 16 wherein said reallocating means comprises:

means for loading a first reduced color set for said image colors in image color locations in said default table, said first reduced color set having fewer colors than all image colors;

means for testing for said default table being full before said first reduced color set is completely loaded; and means, in response to said default table being full, for replacing colors in color locations allocated to said first reduced color set with a second reduced color set having fewer colors than said first reduced color set.

19. The program module of claim 16 wherein said reallocating means comprises:

means for loading a true set of colors for said image colors;

means for testing for said default table being full before said true set is completely loaded; and means for substituting a color already loaded in said default table for each color in said true set that is not loaded before said table was full, said substituted color being a color in said table that is closest in color and intensity to an unloaded true color.

20. The program module of claim 19 wherein each color location is defined by a color index and said substituting means comprises:

means for comparing each unloaded true image color to each loaded color to determine a loaded color that is closest in color and intensity to each unloaded true color; and means for changing the color index of each unloaded true color to the color index of said determined closest loaded color.

21. The program module of claim 16 wherein said computing system has a first color table in said memory in addition to said default table, and said window manager program transfers colors to be displayed to said display table from said first table rather than from said default table, said program module in addition comprising:

means for allocating said base colors to locations in said first color table;

means for assigning each base color to one or more classes, each class having a priority with respect to every other class;

means for allocating said image colors to locations in said first table until said first table is full; and means for reallocating image colors to base color locations in said first table to replace base colors at said base color locations with image colors until all image colors are allocated a location in said first table, lowest priority base colors being replaced first.

22. The program module of claim 21 wherein said reallocating means comprises:

means for finding each unallocated image color a location in said first table containing said lowest priority base color; and means for replacing said lowest priority base color at each location found by said finding means with an unallocated image color whereby all image colors are allocated locations in said first color table.

23. A method for managing color selection for a windowing display that displays multiple computer program applications on a single screen in order to minimizes screen flashing, comprising the steps of:

providing a common color table having a plurality of storage locations that are utilized in common by all program applications to provide non-image and image colors for use in screen display;

providing a first allocation step that allocates color table storage locations to a plurality of base colors that are usable in said non-image display areas and support non-image display of all of said program applications, said base colors having an assigned priority;

after said first allocation step, providing a second allocation step that allocates storage locations in said color table to plurality of said image colors that are usable in image display areas and support image display of all of said program applications;

sensing when all storage locations of said color table have been allocated during said second allocation step before all of said image colors have been allocated a storage location in said color table, and thereby defining unallocated image colors, and in that event; and utilizing said base color priority to replacing base colors stored in said color table during said second allocation step by assigning storage locations of said base colors to said defined unallocated image colors.

* * * * *